US010626700B2

(12) United States Patent
Vasques

(10) Patent No.: US 10,626,700 B2
(45) Date of Patent: Apr. 21, 2020

(54) DOWNHOLE DRILLING SYSTEM

(71) Applicant: Welltec Oilfield Solutions AG, Zug (CH)

(72) Inventor: Ricardo Reves Vasques, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 129 days.

(21) Appl. No.: 15/634,105

(22) Filed: Jun. 27, 2017

(65) Prior Publication Data

US 2017/0370179 A1 Dec. 28, 2017

(30) Foreign Application Priority Data

Jun. 28, 2016 (EP) ..... 16176632

(51) Int. Cl.

| | |
|---|---|
| ***E21B 33/127*** | (2006.01) |
| ***E21B 33/14*** | (2006.01) |
| ***E21B 33/13*** | (2006.01) |
| ***E21B 17/06*** | (2006.01) |
| ***E21B 33/12*** | (2006.01) |
| ***E21B 33/124*** | (2006.01) |
| ***E21B 7/20*** | (2006.01) |

(Continued)

(52) U.S. Cl.

CPC ..... *E21B 33/14* (2013.01); *E21B 7/20* (2013.01); *E21B 17/06* (2013.01); *E21B 21/08* (2013.01); *E21B 33/127* (2013.01); *E21B 33/1208* (2013.01); *E21B 33/1243* (2013.01); *E21B 33/13* (2013.01); *E21B 47/06* (2013.01)

(58) Field of Classification Search

CPC ..... E21B 17/06; E21B 33/13

USPC ..... 166/250.01

See application file for complete search history.

(56) References Cited

U.S. PATENT DOCUMENTS

| | | | | |
|---|---|---|---|---|
| 2003/0062169 | A1 | 4/2003 | Marshall | |
| 2013/0043023 | A1 * | 2/2013 | Hallundbaek | E21B 43/128 166/250.15 |
| 2013/0068481 | A1 | 3/2013 | Zhou | |

(Continued)

FOREIGN PATENT DOCUMENTS

| | | |
|---|---|---|
| EP | 2 644 821 | 10/2013 |
| EP | 2 947 259 | 11/2015 |

OTHER PUBLICATIONS

Extended Search Report for EP16176632.4 dated Dec. 13, 2016, 9 pages.

(Continued)

*Primary Examiner* — Taras P Bemko

(74) *Attorney, Agent, or Firm* — Nixon & Vanderhye P.C.

(57) ABSTRACT

A drill string has a first part and a second part closer to a top of the well. The first part has a drilling head and an annular barrier with a tubular metal part, an expandable metal sleeve and an annular space between the inner face of the expandable metal sleeve and the tubular metal part. Drilling is commenced and then stopped when a loss of formation pressure is detected. A ball is dropped into the drill string and the drill string is pressurized. The expandable metal sleeve is expanded with pressure until the expandable metal sleeve abuts the inner face of the borehole. The second part of the drill string is separated from the first part and pulled out of the borehole. Cement is injected into the borehole above the first part to provide a cement plug above the first part.

16 Claims, 12 Drawing Sheets

Figure 1:
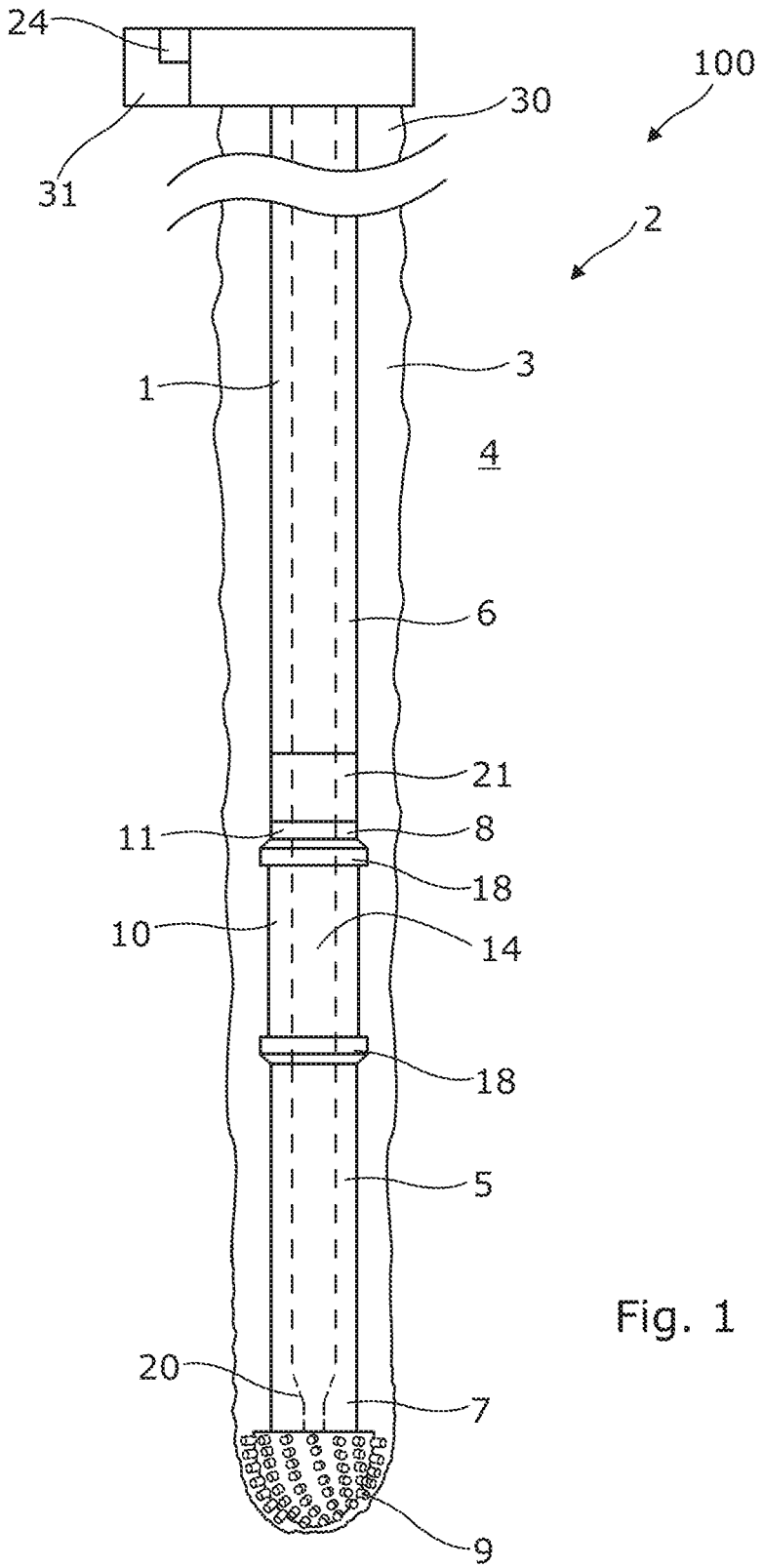

(51) Int. Cl.
*E21B 21/08* (2006.01)
*E21B 47/06* (2012.01)

(56) References Cited

U.S. PATENT DOCUMENTS

2014/0216755 A1* 8/2014 Hallundæk ..... E21B 23/06
166/373
2015/0275605 A1* 10/2015 Bennett ..... E21B 29/002
166/298
2015/0300154 A1* 10/2015 Hallundb k ..... E21B 33/127
166/250.17
2017/0101847 A1* 4/2017 Hazel ..... E21B 17/05

OTHER PUBLICATIONS

Invitation to Pay Additional Fees with Partial International Search Report dated Sep. 26, 2017 in International Application No. PCT/EP2017/065754 (13 pages).

* cited by examiner

DOWNHOLE DRILLING SYSTEM

This application claims priority to EP Patent Application No. 16176632.4 filed Jun. 28, 2016, the entire content of which is hereby incorporated by reference.

The present invention relates to a downhole drilling method for drilling a well in a formation having a formation pressure. Furthermore, the present invention relates to a downhole drilling system for performing the downhole drilling method according to the present invention and to a downhole completion system.

When drilling a new borehole or sidetrack in an existing well, the drilling head may drill into a low pressure zone, resulting in a loss of pressure. This means that the mud entered into the hole while drilling to prevent a blowout is lost in the low pressure zone, and there will be a substantial risk of a blowout if the drilling is continued. Cementing and thus sealing part of the annulus above the low pressure zone are also impossible, since the injected cement is lost as it disappears into the low pressure zone, and it can thus be very difficult to seal off the borehole/well in a manner safe enough to abandon the well.

It is an object of the present invention to wholly or partly overcome the above disadvantages and drawbacks of the prior art. More specifically, it is an object to provide an improved downhole drilling system which is able to prevent a blowout if the drilling system drills into a low pressure zone.

Furthermore, it is an object to provide an improved downhole completion system which can be deployed longer into the formation or more easily than known completion systems while still being able to prevent blowouts.

The above objects, together with numerous other objects, advantages and features, which will become evident from the below description, are accomplished by a solution in accordance with the present invention by a downhole drilling method for drilling a well in a formation having a formation pressure, comprising:

- providing a drill string having a first part and a second part, the second part being arranged closer to a top of the well than the first part, and the first part having a drilling head in a first end and an annular barrier arranged closer to the top of the well than the drilling head, the annular barrier comprising:
- a tubular metal part for mounting as part of the first part of the drill string, the tubular metal part having an outer face,
- an expandable metal sleeve surrounding the tubular metal part and having an inner face facing the tubular metal part and an outer face facing an inner face of a borehole of the well, each end of the expandable metal sleeve being connected with the tubular metal part, and
- an annular space between the inner face of the expandable metal sleeve and the tubular metal part, the expandable metal sleeve being configured to expand,
- drilling the borehole by means of the drilling head,
- detecting the formation pressure to determine any loss of formation pressure,
- stopping the drilling,
- dropping a ball into the drill string,
- pressurising the drill string until the ball reaches a ball seat arranged opposite or below the annular barrier,
- expanding the expandable metal sleeve by further pressurising the drill string until the expandable metal sleeve abuts the inner face of the borehole,
- separating the second part of the drill string from the first part,

- pulling the second part out of the borehole, and
- injecting cement into the borehole above the first part to provide a cement plug above the first part.

Separating the first part and the second part may be performed by disconnecting the second part from the first part by activating a disconnecting unit.

Furthermore, the activation of the disconnecting unit may be performed by bursting a burst disc of the disconnecting unit by further pressurising the drill string until reaching a predetermined pressure which is larger than an expansion pressure required for expanding the expandable metal sleeve.

In addition, the step of pulling the second part may be performed by pulling the second part partly away from the first part, then injecting cement through the second part into the borehole above the first part, and subsequently pulling the second part out of the borehole.

Moreover, the method may comprise abandoning the borehole to drill a new borehole offset the borehole.

The present invention furthermore relates to a downhole drilling system for performing the downhole drilling method according to the present invention for drilling a borehole of a well in a formation having a formation pressure, comprising:

- a drill string having a first part and a second part, the first part having a first end and a second end, the second end being connected to the second part,
- a drilling head connected to the first end, the first part comprising an annular barrier, the annular barrier comprising:
  - a tubular metal part for mounting as part of the first part of the drill string, the tubular metal part having an outer face,
  - an expandable metal sleeve surrounding the tubular metal part and having an inner face facing the tubular metal part and an outer face facing an inner face of the borehole, each end of the expandable metal sleeve being connected with the tubular metal part, and
  - an annular space between the inner face of the expandable metal sleeve and the tubular metal part, the expandable metal sleeve being configured to expand, wherein the first part comprises a ball seat arranged opposite or below the annular barrier, and wherein the downhole drilling system further may comprise a disconnecting unit configured to disconnect the second part from the first part.

Furthermore, the disconnecting unit may be mounted as part of the drill string.

Also, the disconnecting unit may comprise a burst disc configured to burst at a predetermined pressure.

Moreover, the predetermined pressure may be larger than an expansion pressure required for expanding the expandable metal sleeve.

Additionally, the drill string may be an assembly of drill pipes.

Furthermore, the drill pipes may have an outer diameter and a wall thickness of at least 10% of the outer diameter.

The drill casing string may be an assembly of casing sections having a larger outer diameter than the drill pipe.

Also, the annular space between the inner face of the expandable metal sleeve and the tubular metal part may have a distance in the radial extension in an unexpanded condition, the distance being larger than 1.5 cm.

Moreover, the downhole drilling system may further comprise a pressurising device configured to pressurise the drill string.

The present invention also relates to a downhole completion system for permanently completing a well having a borehole in a formation having a formation pressure, the downhole completion system comprising:

a casing string having a first part and a second part, the first part having a first end and a second end, the second end being connected to the second part, and a drilling head connected to the first end, wherein the first part of the casing string comprises at least two annular barriers, each annular barrier comprising:

a tubular metal part for mounting as part of the first part of the casing string, the tubular metal part having an outer face, an expandable metal sleeve surrounding the tubular metal part and having an inner face facing the tubular metal part and an outer face facing an inner face of the borehole, each end of the expandable metal sleeve being connected with the tubular metal part, and an annular space between the inner face of the expandable metal sleeve and the tubular metal part, the expandable metal sleeve being configured to expand, wherein the first part comprises a ball seat arranged opposite or below the annular barrier closest to the drilling head.

By having an expandable metal sleeve arranged circumferenting and fastened to the casing string, the casing string is more rigid, and therefore it is possible to drill using such casing string with annular barriers having expandable metal sleeves.

By being able to drill with the casing string due to the casing string being more rigid than known strings, the completion system can be deployed further into the formation as the casing string is not stuck when being deployed in an already drilled borehole, since the drilling head is leading the way. Furthermore, isolation of production zones is very easily performed by just dropping a ball and pressurising the casing string from the top of the well.

Furthermore, by having a ball seat below the annular barrier closest to the drilling head, several annular barriers can be expanded substantially simultaneously by pressurising the casing string from above or from surface.

Moreover, the second part may be disconnected from the first part.

The downhole completion system as described above may further comprise a production casing for prolonging the casing string to a top of the well.

Said downhole completion system as described above may further comprise an inflow control section arranged between two annular barriers of the first part and/or the second part.

In addition, the downhole completion system as described above may further comprise a disconnecting unit configured to disconnect the second part from the first part.

The downhole drilling system may further comprise a detecting unit arranged at a top of the well.

Also, the tubular metal part may have a first expansion opening, the expandable metal sleeve being configured to expand by injecting pressurised fluid into the annular space through the first expansion opening.

Moreover, the annular space between the inner face of the expandable metal sleeve and the tubular metal part may have a distance in an unexpanded condition, the distance being larger than 1.5 cm.

Further, the expandable metal sleeve may be partly or fully made of metal.

In addition, the first part of the drill pipe may comprise two or more annular barriers.

Furthermore, the downhole drilling system may further comprise a pulling arrangement at the top of the well, the pulling arrangement being configured to pull the second part of the drill string.

Moreover, the downhole drilling system may further comprise a pressurising device configured to pressurise the casing string.

Further, the first part may be mounted from casing sections and the second part may be mounted from drill pipe sections.

The present invention also relates to a downhole drilling method for drilling a well in a formation having a formation pressure, comprising:

providing a casing string having a first part and a second part, the second part being arranged closer to a top of the well than the first part, and the first part having a drilling head in a first end and at least two annular barriers arranged closer to the top of the well than the drilling head, each annular barrier comprising:

a tubular metal part for mounting as part of the first part of the drill string, the tubular metal part having an outer face, an expandable metal sleeve surrounding the tubular metal part and having an inner face facing the tubular metal part and an outer face facing an inner face of a borehole of the well, each end of the expandable metal sleeve being connected with the tubular metal part, and an annular space between the inner face of the expandable metal sleeve and the tubular metal part, the expandable metal sleeve being configured to expand, drilling the borehole by means of the drilling head, detecting that the drilling has stopped or that the formation pressure is too low to continue drilling, stopping the drilling head, dropping a ball into the casing string, pressurising the casing string until the ball reaches a ball seat arranged opposite or below the annular barrier closest to the drilling head, and expanding the expandable metal sleeves of the annular barriers by further pressurising the casing string until the expandable metal sleeves abuts the inner face of the borehole.

Moreover, the expandable metal sleeves of the annular barriers may be expanded substantially simultaneously.

The downhole drilling method as described above may further comprise disconnecting the second part from the first part.

Also, the downhole drilling method as described above may further comprise inserting a production casing for prolonging the casing string to a top of the well.

Finally, the downhole drilling system may further comprise a ball to be dropped into the drill string.

Figure 2:
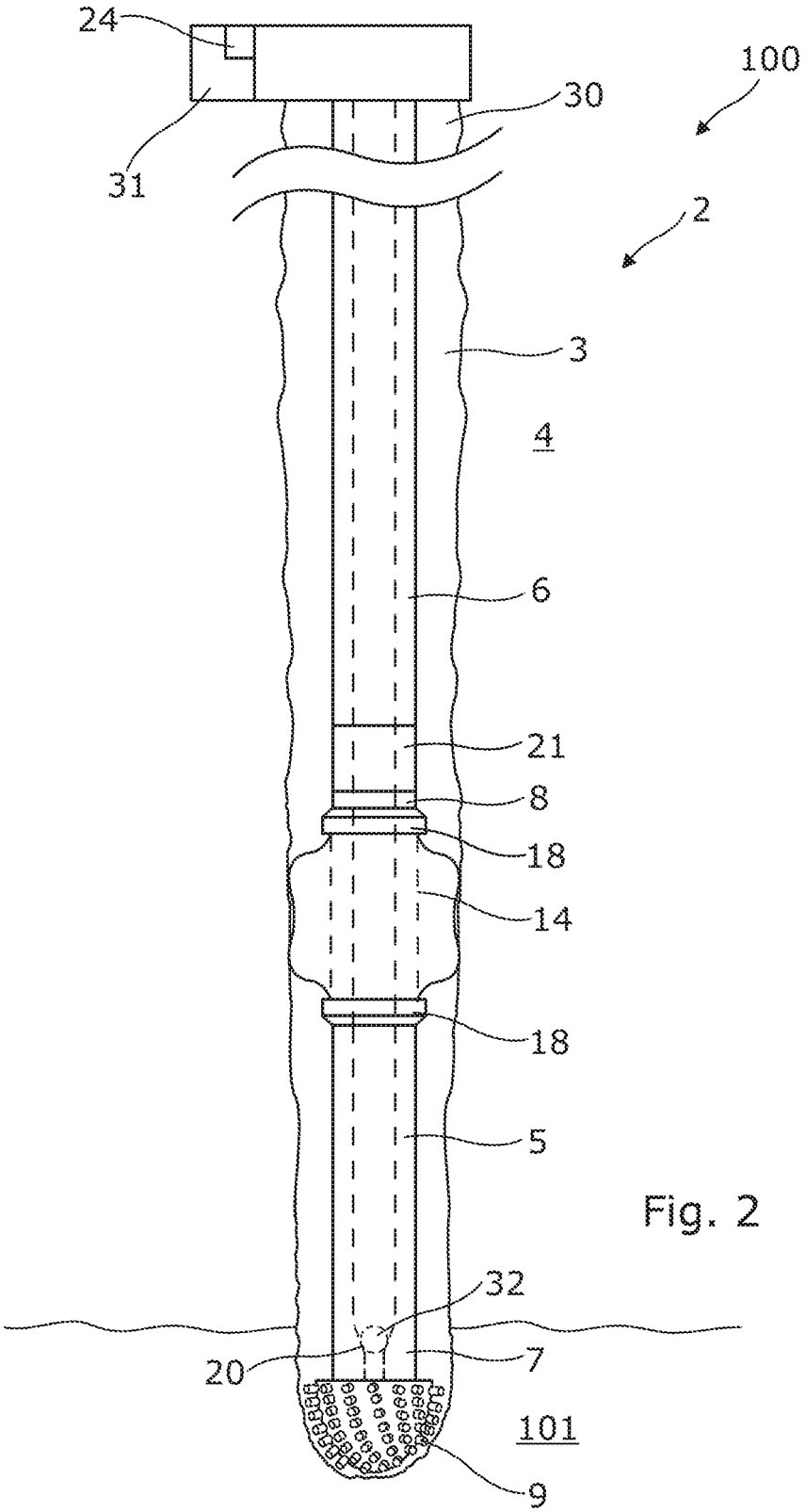
Figure 3:
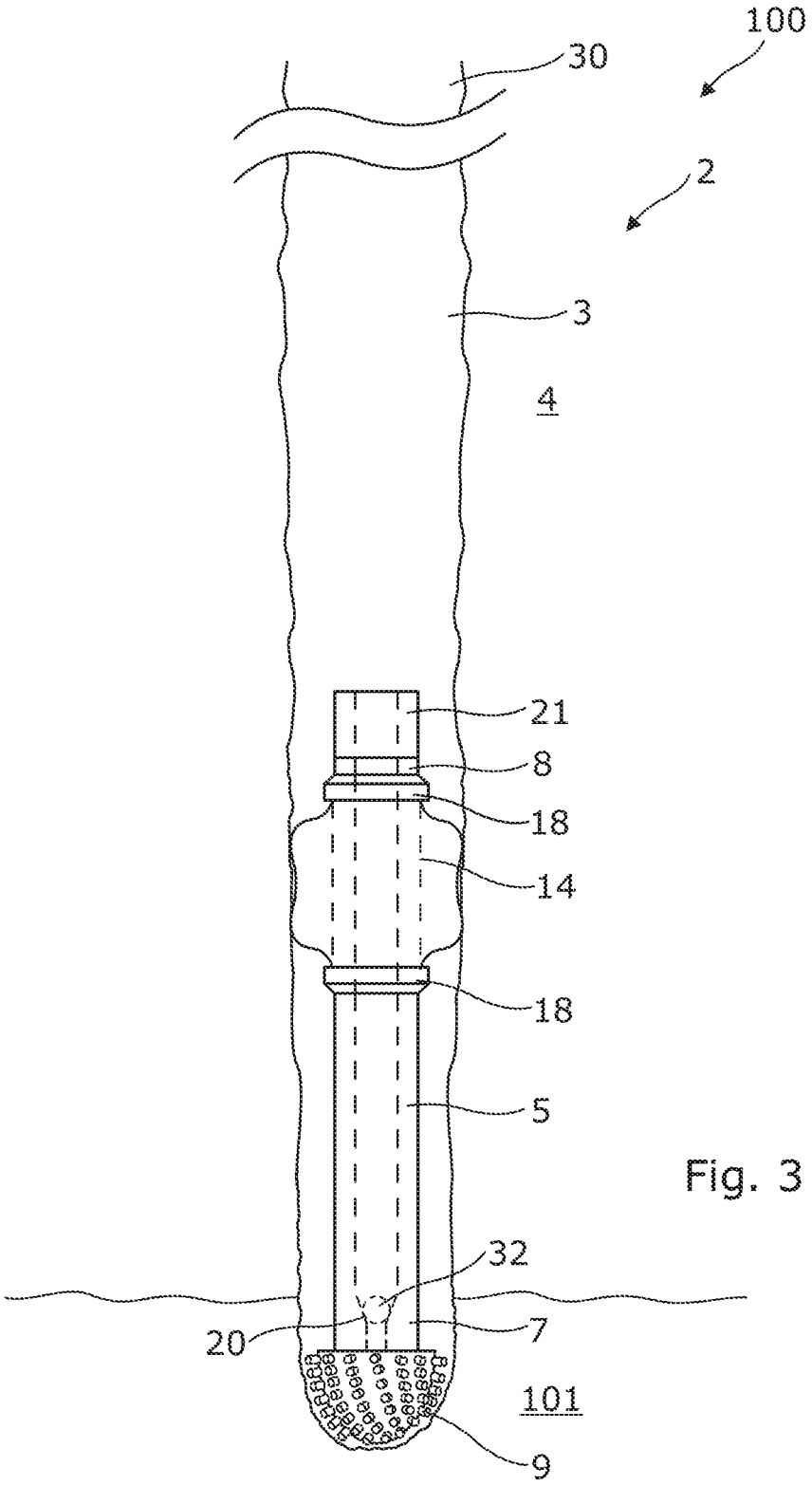
Figure 4:
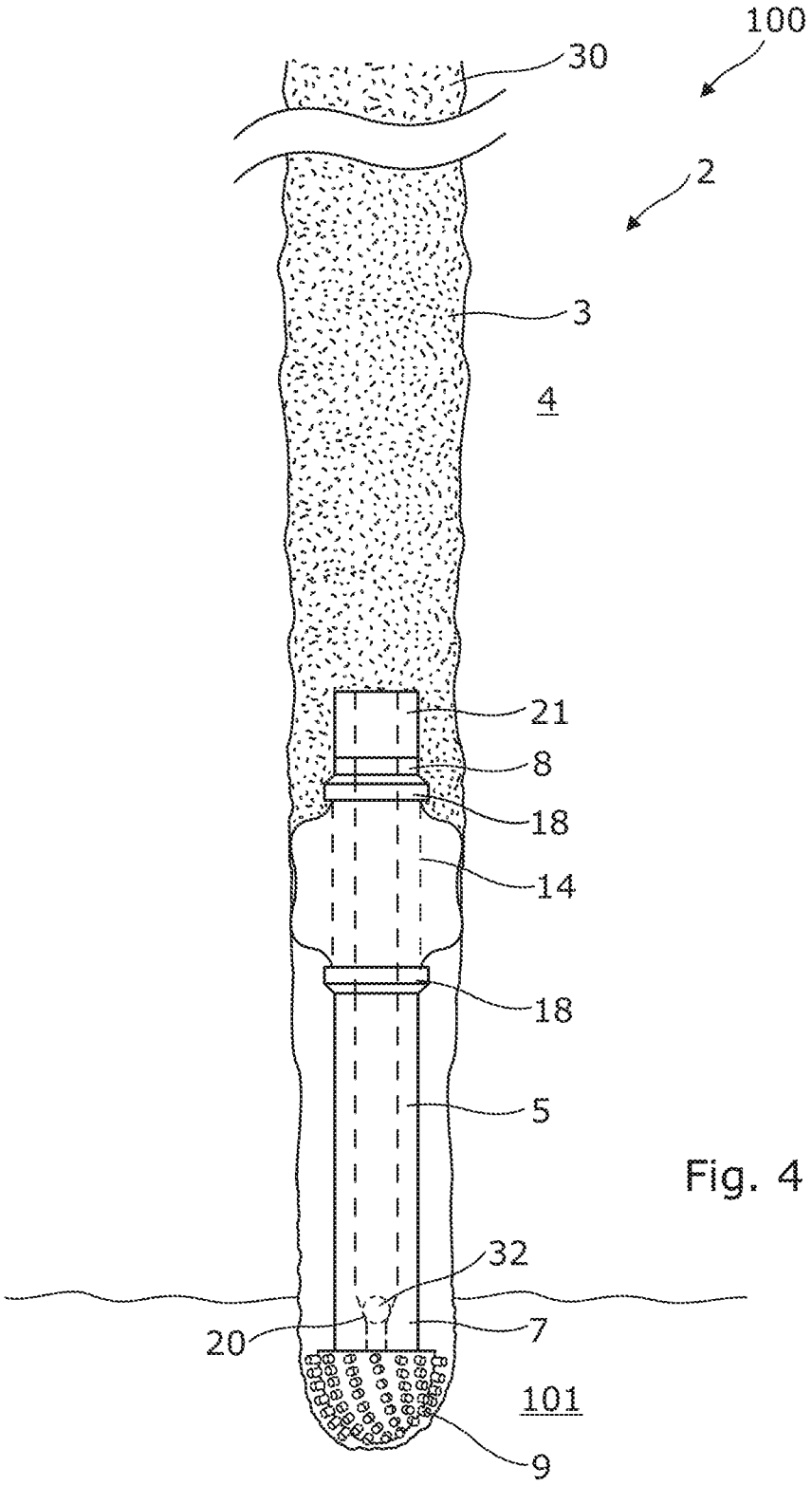
Figure 5:
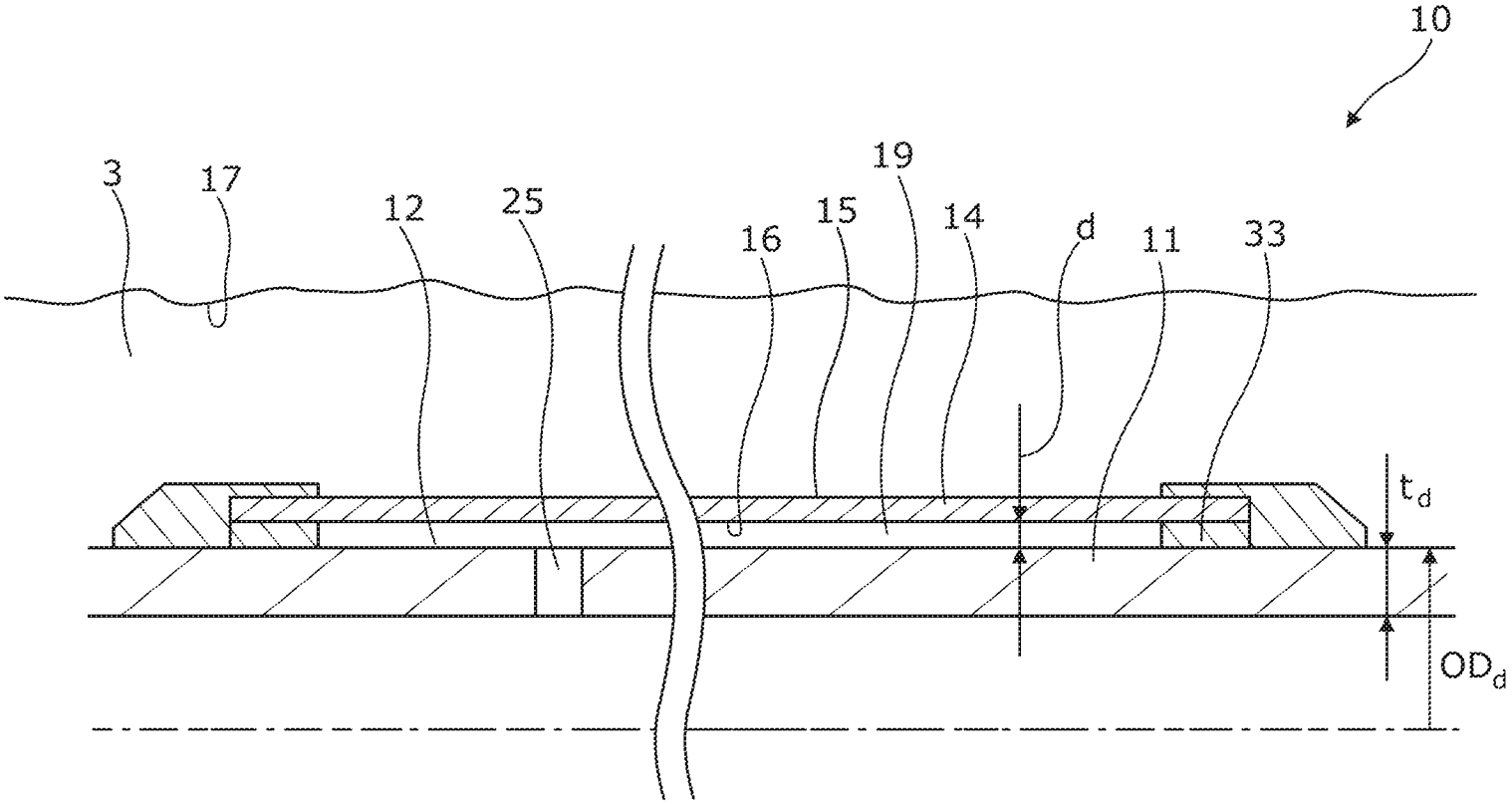
Figure 6:
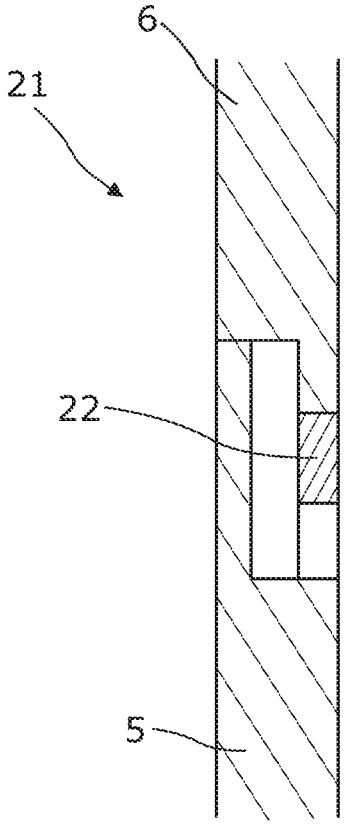
Figure 7:
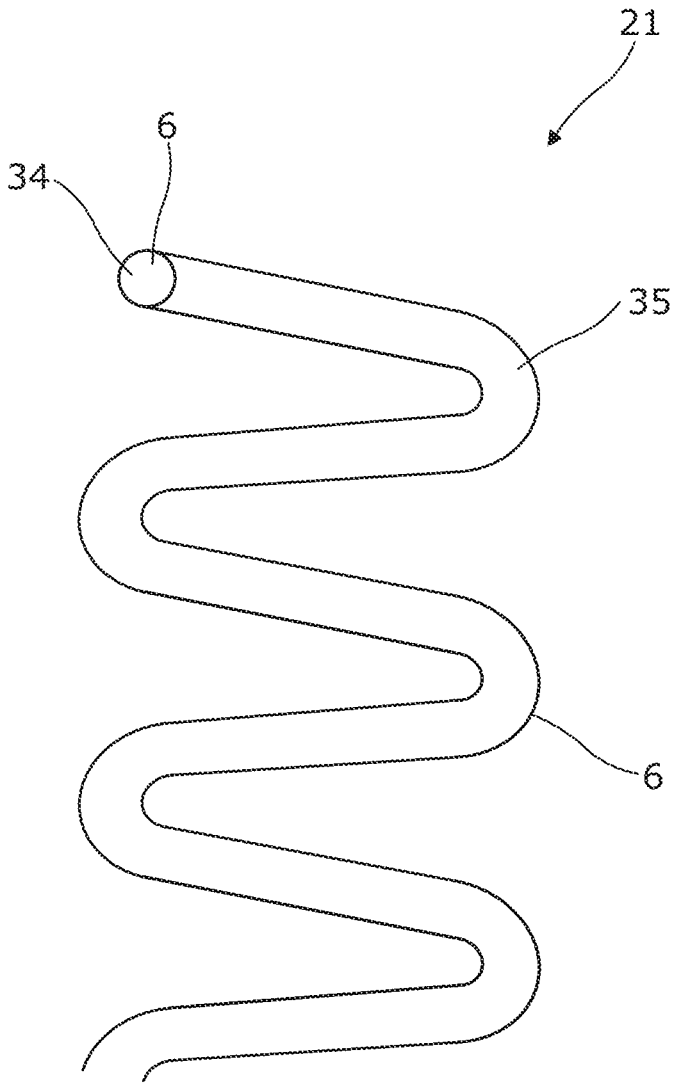
Figure 8:
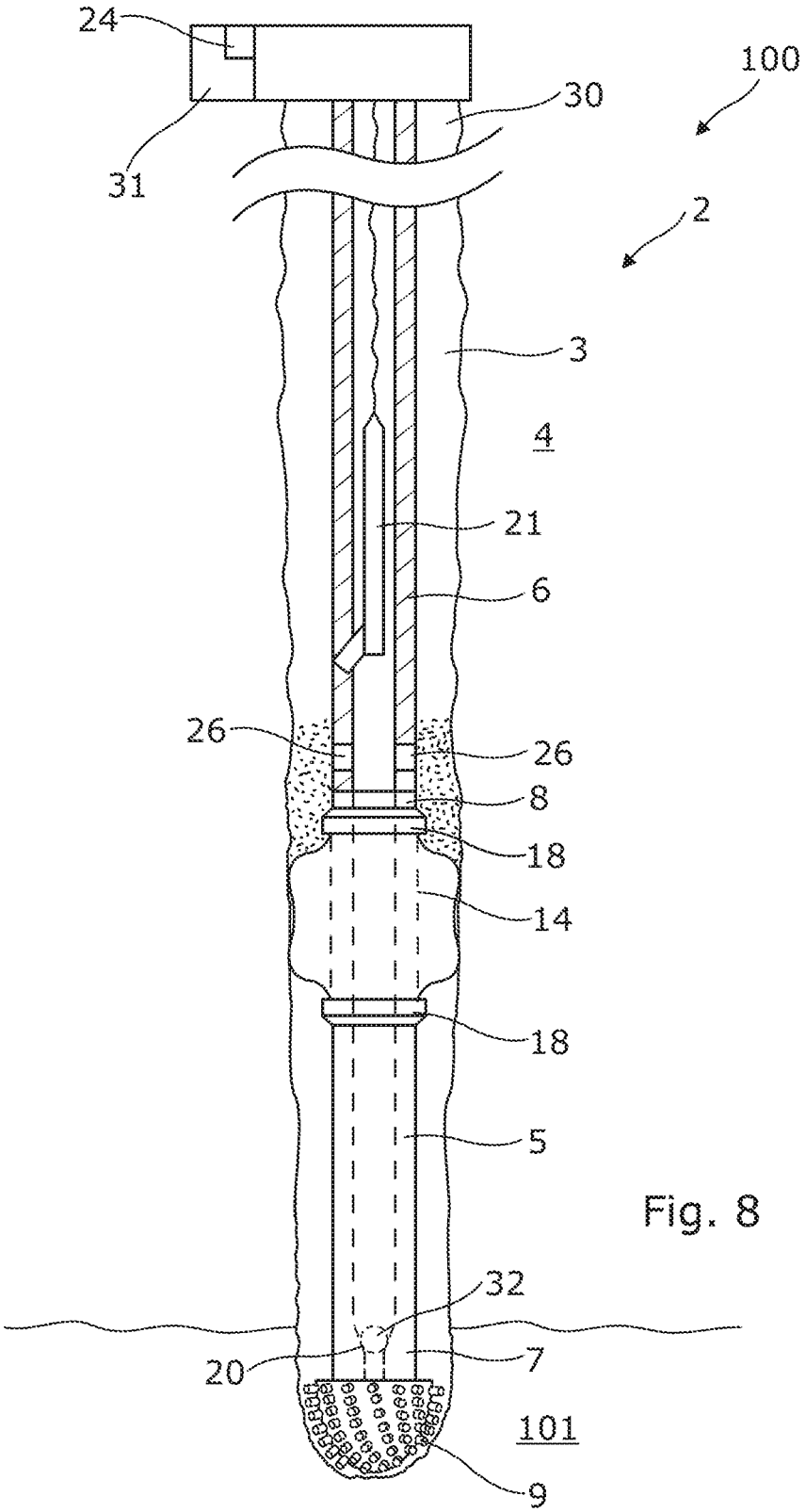
Figure 9:
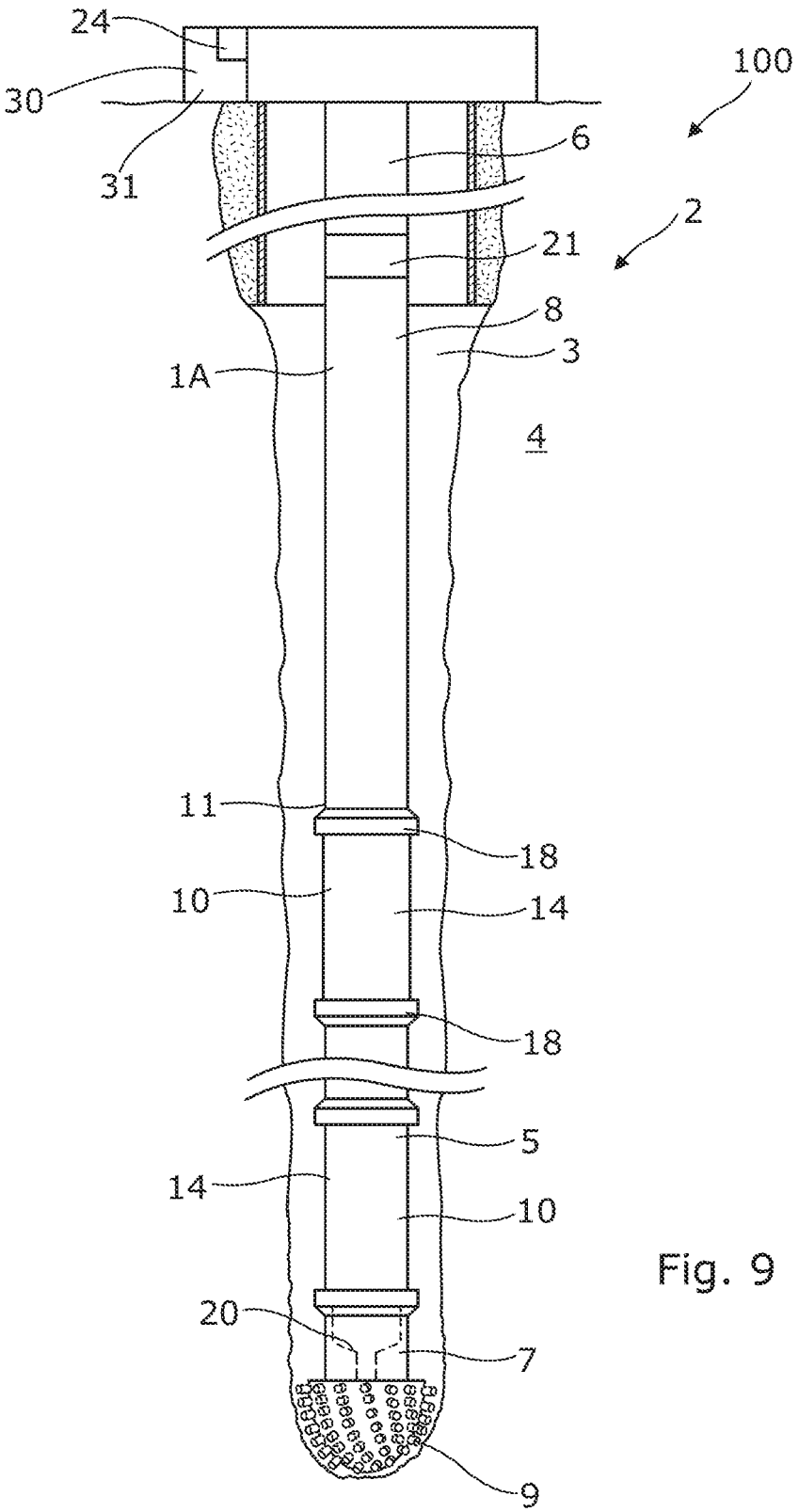
Figure 10:
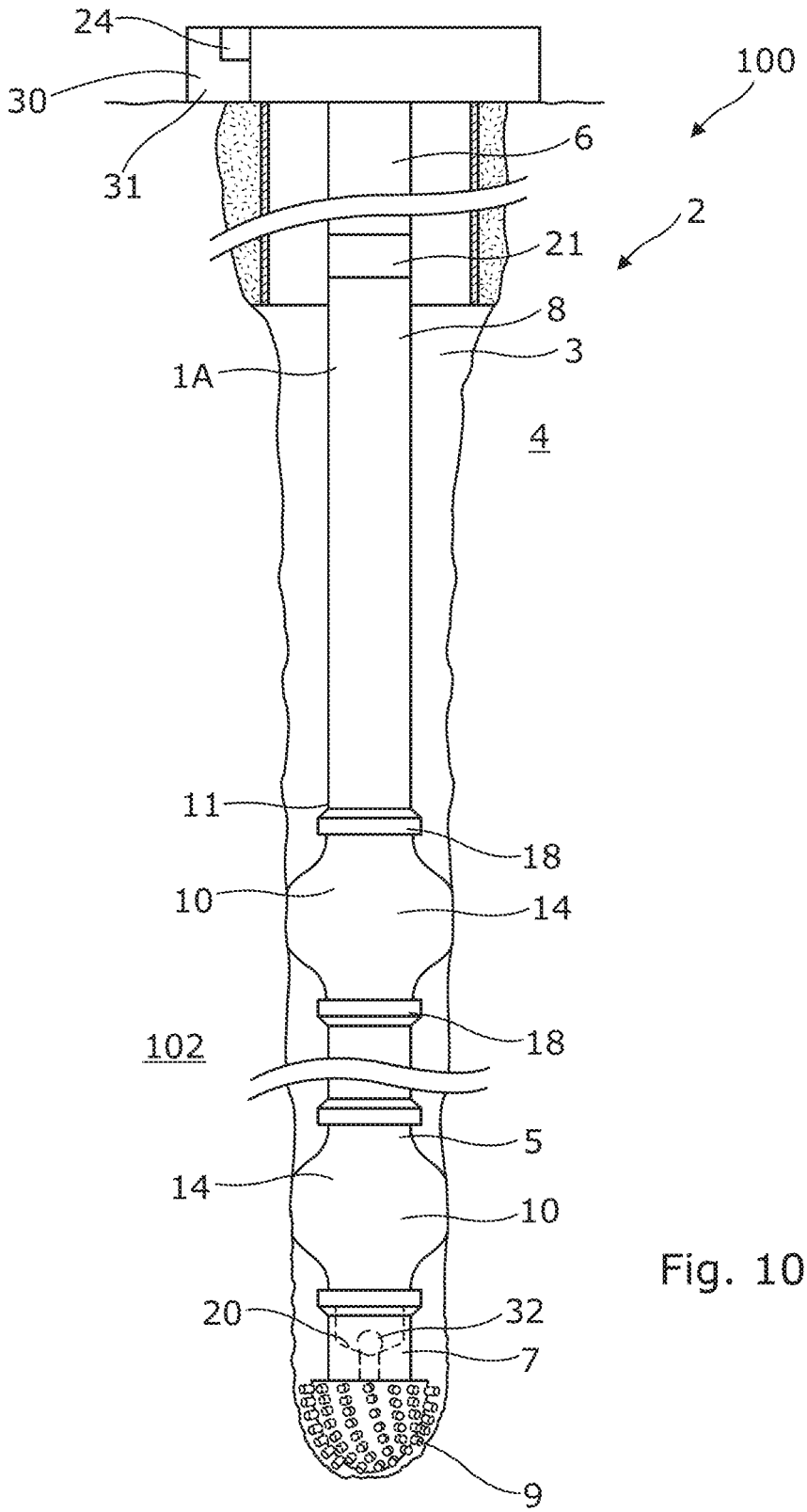
Figure 11:
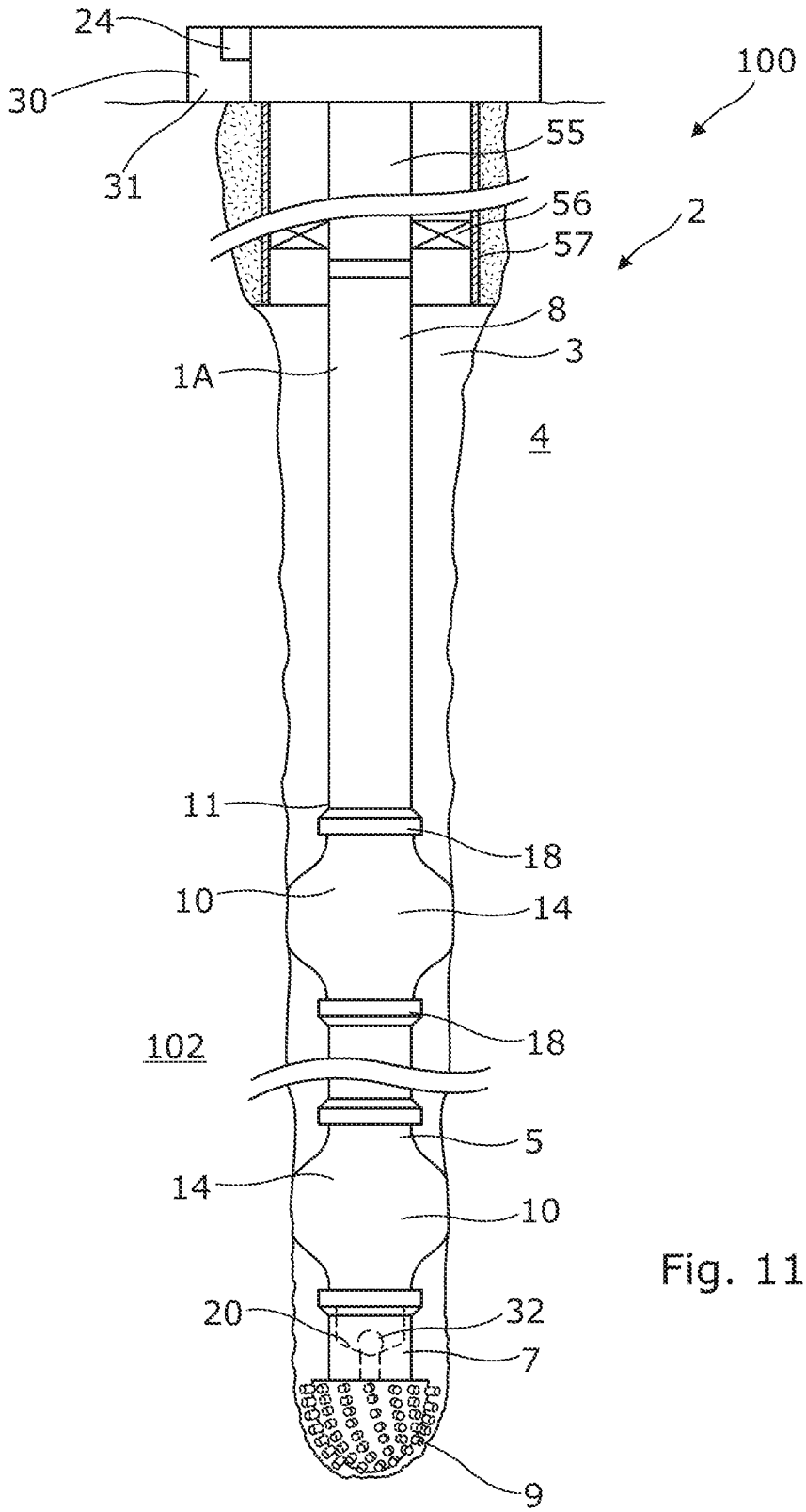
Figure 12:
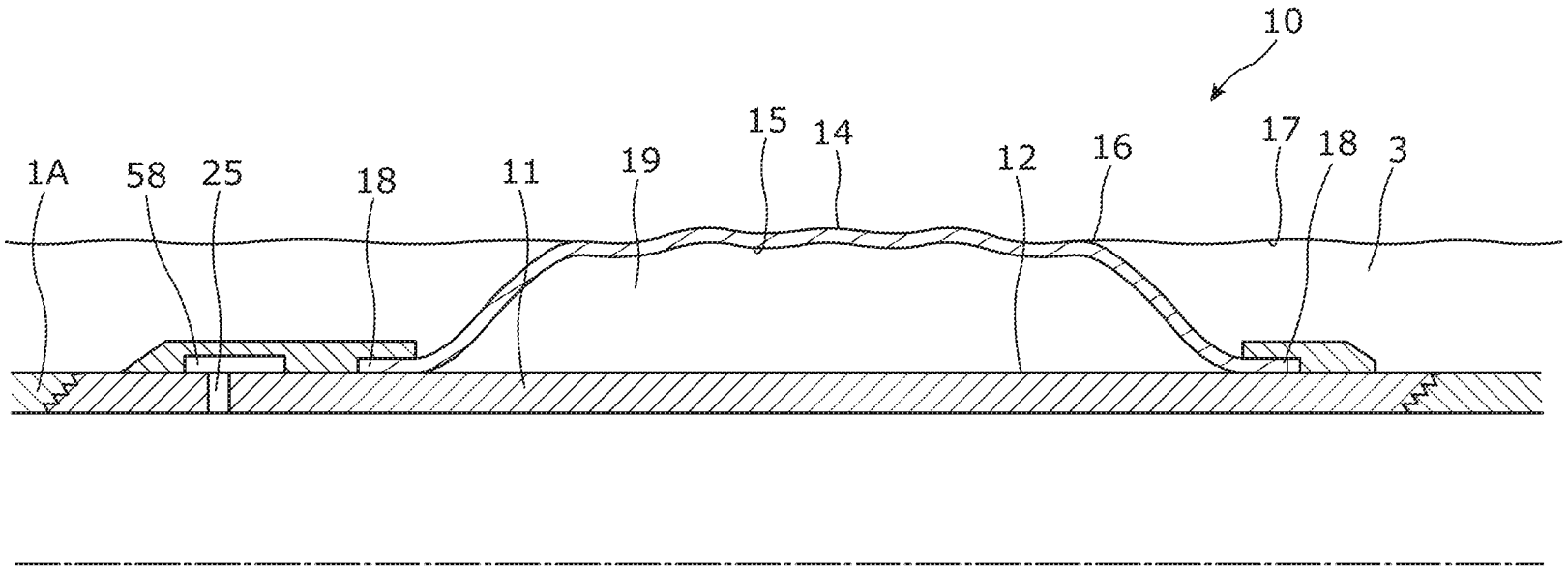

The invention and its many advantages will be described in more detail below with reference to the accompanying schematic drawings, which for the purpose of illustration show some non-limiting embodiments and in which FIG. 1 shows a downhole drilling system drilling a borehole having an unexpanded annular barrier, FIG. 2 shows the downhole drilling system of FIG. 1 in which the annular barrier has been expanded, FIG. 3 shows the downhole drilling system in which the second part has been pulled out of the borehole, FIG. 4 shows the downhole drilling system of FIG. 3 in which cement has been poured onto the top of the annular barrier to plug the well, FIG. 5 shows a cross-sectional view of an annular barrier, FIG. 6 shows a disconnecting unit, FIG. 7 shows part of another disconnecting unit, FIG. 8 shows a partly cross-sectional view of another downhole drilling system, FIG. 9 shows a partly cross-sectional view of another downhole drilling system in which the string is a casing string, FIG. 10 shows a partly cross-sectional view of the downhole drilling system of FIG. 9 in which the annular barriers have been expanded, FIG. 11 shows a partly cross-sectional view of the downhole drilling system of FIG. 9 in which the annular barriers have been expanded and the second part has been disconnected, and FIG. 12 shows a cross-sectional view of an annular barrier.

All the figures are highly schematic and not necessarily to scale, and they show only those parts which are necessary in order to elucidate the invention, other parts being omitted or merely suggested.

FIG. 1 shows a downhole drilling system 100 for performing downhole drilling of a borehole 3 of a well 2 in a formation 4 which may have a zone having significantly low formation pressure. When drilling into such a zone, mud circulation is lost due to "loss of pressure", i.e. the formation pressure drops substantially and the mud pumped down the borehole 3 to prevent a blowout is lost into the zone instead of sealing the borehole during the drilling to prevent the blowout. When experiencing a loss of pressure, mud can no longer seal the borehole 3, which entails a substantial risk of a blowout occurring. Therefore, part of the borehole 3 needs to be secured or even shut off before the drilling operation can continue in another direction or before the well/borehole is abandoned. The downhole drilling system 100 comprises a drill string 1 having a first part 5 and a second part 6. The second part 6 is arranged closest to a top 30 of the well 2, and the first part 5 has a first end 7 connected with a drilling head 9 and a second end 8 connected to the second part. The first part 5 comprises an annular barrier 10 which comprises a tubular metal part 11 for mounting as part of the first part of the drill string 1. The annular barrier 10 further comprises an expandable metal sleeve 14 surrounding the tubular metal part. Each end 18 of the expandable metal sleeve 14 is connected with the tubular metal part, thereby defining an annular space 19 (shown in FIG. 5) between an inner face of the expandable metal sleeve 14 and the tubular metal part. The expandable metal sleeve 14 is configured to expand and is shown in its unexpanded state in FIG. 1. The first part 5 of the drill string 1 also comprises a ball seat 20 arranged below the annular barrier so that in the event that pressure is lost while drilling into the zone, a ball can be dropped into the drill string. The inside of the drill string is then pressurised until the ball seats in the ball seat 20, and a pressure inside the drill string is subsequently built up and the pressurised fluid is used to expand the expandable metal sleeve 14 and thus seal off the zone 101 which the drilling head 9 drills in, as shown in FIG. 2, since the annular barrier is arranged above the drilling head so that the zone having a low pressure is below the annular barrier. By sealing off the low pressure zone 101, the risk of a blowout is reduced, as the first part 5 of the drill string together with the annular barrier seal off the low pressure zone 101 because the ball 32 seats in the ball seat 20 and seals off the drill string from within.

The downhole drilling system 100 further comprises a disconnecting unit 21 configured to disconnect the second part 6 from the first part 5 after the annular barrier has been expanded. When the annular barrier has been expanded and the low pressure zone 101 sealed off, the disconnecting unit 21 is activated, e.g. by mud pulsing, increasing the pressure or by dropping a second ball having a larger diameter seating in the disconnecting unit 21. The disconnecting unit 21 may comprise a slot 35 and a pin 34 engaging the slot 35, as shown in FIG. 7, and the mud pulses activate the pin to slide in the slot, and when reaching the end of the slot, the pin disengages and the second part 6 is disconnected from the first part of the drill string. The disconnecting unit 21 may comprise a burst disc 22, as shown in FIG. 6, configured to burst at a predetermined pressure above the operating pressure when drilling and above the pressure required for expanding the annular barrier. The burst disc 22 and the slot and pin solution may also be combined in the disconnecting unit 21. Once activated, the disconnecting unit 21 disconnects the second part of the drill string, and the second part is retracted from the well 2, as shown in FIG. 3. Subsequently, cement can be poured into the borehole 3 on top of the annular barrier and into the first part 5 of the drill string, as shown in FIG. 4, and the well 2 is then plugged and can be safely abandoned. By having a disconnecting unit 21, the second part can be withdrawn from the borehole 3, and the borehole can be safely abandoned. If the second part of the drill string is not pulled out, the metal may deteriorate over time, which allows the well fluid to seep along the metal drill string, which entails a risk of a leaking borehole and a potential blowout.

The drill string of FIG. 8 may also be cut by means of a cutting tool functioning as the disconnecting unit 21 for providing a circumferential cut in the drill string and for disconnecting the second part 6 from the first part 5 when the annular barrier has been expanded.

Furthermore, the tool may be a drilling tool drilling at least one hole 26 in the drill string so that cement can be injected from within the drill string out through the hole and into the borehole between the drill string and the borehole wall before the second part of the drill string is disconnected from the first part. In another not shown aspect, the drill string comprises a disconnecting unit 21 connected between the first part 5 and the second part 6 and being arranged above the holes 26.

The annular barrier 10 of FIG. 5 has an expandable metal sleeve 14 surrounding the tubular metal part 11. The expandable metal sleeve 14 has an inner face 15 facing an outer face 12 of the tubular metal part, and an outer face 16 of the expandable metal sleeve 14 faces an inner face 17 of the borehole 3. The tubular metal part 11 has a first expansion opening 25, and the expandable metal sleeve 14 is configured to expand when pressurised fluid is let into the annular space 19 through the first expansion opening.

The drill string is an assembly of drill pipes, and the drill pipes have an outer diameter $OD_d$ and a wall thickness $t_d$ of at least 10% of the outer diameter so as to transfer rotational force while drilling. The downhole drilling system 100 shown in FIG. 1 further comprises a detecting unit 24 arranged at a top 30 of the well 2 in order to detect the pressure in the drill string while drilling and during possible drill stops in the drilling operation. The first part of the drill pipe may comprise two or more annular barriers.

As can be seen in FIG. 5, the annular space between the inner face 15 of the expandable metal sleeve 14 and the tubular metal part has a distance d in an unexpanded condition. When expanding, the expandable metal sleeve 14 expands from an unexpanded diameter to an expanded diameter. By having the distance d and thus an element 33 for creating the distance, the unexpanded diameter of the expandable metal sleeve 14 is larger, meaning that the expandable metal sleeve does not have to expand as much as if the expandable metal sleeve was not arranged outside the element 33. The distance may be larger than 1.5 cm.

In order to pull the second part 6 out of the well 2, the downhole drilling system 100 further comprises a pulling arrangement at the top of the well. Furthermore, the downhole drilling system 100 further comprises a pressurising device 31 configured to pressurise the drill string, as shown in FIG. 1.

FIG. 9 shows a downhole completion system 100 for drilling and permanently completing a well 2 having a borehole 3 in a formation 4. The downhole completion system 100 comprises a casing string 1A having a first part 5 and a second part 6, the first part having a first end 7 and a second end 8, where the second end is connected to the second part. The first end is connected to a drilling head 9 and comprises at least two annular barriers 10. Each annular barrier comprises, as shown in FIG. 12, a tubular metal part 11 for mounting as part of the first part of the casing string, an expandable metal sleeve 14 surrounding the tubular metal part and having an inner face 15 facing the tubular metal part and an outer face 16 facing an inner face 17 of the borehole. Each end 18 of the expandable metal sleeve is connected with the tubular metal part, and an annular space 19 is defined between the inner face of the expandable metal sleeve and the tubular metal part. The expandable metal sleeve is configured to be expanded by introducing pressurised fluid in through the expansion opening 25 in the tubular metal part. As shown in FIG. 9, the first part of the casing string comprises a ball seat 20 arranged opposite or below the annular barrier closest to the drilling head. By having expandable metal sleeves arranged circumferenting and fastened to the casing string, the casing string is more rigid than known casings, and it is therefore possible to drill using such casing string with annular barriers having expandable metal sleeves instead of the drill string. The well can thus be drilled and then completed by means of the casing string comprising annular barriers having expandable metal sleeves.

Furthermore, by having a ball seat 20 below the annular barrier 10 closest to the drilling head 9, several annular barriers 10 can be expanded substantially simultaneously by dropping a ball 32 and pressurising the casing string 1A from above, the top 30 or from surface, as shown in FIG. 10, in which the annular barriers are all expanded.

When the drilling head cannot drill any further or has reached its final destination, a ball is dropped and the inside of the casing string is expanded to expand the expandable metal sleeves of the annular barriers. Hereby, the annular barriers 10 isolate a production zone 102, and production of hydro-carbon-containing fluid can easily be initiated by opening an inflow section arranged therebetween or by providing openings by perforating the casing string between the annular barriers. The annular barriers may be expanded via an expansion unit 58 (shown in FIG. 12), which has a valve system having a first position in which fluid from the tubular part is allowed into the space 19 and a second position in which fluid communication between the annulus and the space is provided in order to equalise the pressure.

The second part 6 of the casing string is disconnected from the first part 5 by means of a connecting unit 21. After the annular barriers have been expanded, the second part 6 is disconnected from the first part, and a production casing 55 is inserted for prolonging the casing string to a top 30 of the well. The production casing 55 is inserted into the intermediate casing 57 and fastened by means of packers 56 as shown in FIG. 11.

Even though not shown, the downhole completion system may further comprise an inflow control section arranged between two annular barriers of the first part or arranged in a second production casing inserted into the casing string as an inner string.

The annular barriers are expanded when it has been detected that the drilling operation has stopped, the drilling head is stuck or the pressure suddenly drops significantly so that the drilling mud is lost. Such detection may be performed by a detecting unit 24 arranged at a top 30 of the well. In order to pressurise the casing string, the downhole completion system further comprises a pressurising device 31 arranged in the top of the well.

Thus, the invention also relates to a downhole drilling method for drilling and completing a well 2 in a formation 4 having a formation pressure. The drilling method comprises providing the casing string 1A with a first part 5 and a second part 6, where the second part is arranged closer to a top 30 of the well than the first part, and the first part has a drilling head 9 in a first end 7 and at least two annular barriers 10 arranged closer to the top of the well than the drilling head. Then the borehole is drilled by means of the drilling head, and it is detected that the drilling has stopped or that the formation pressure is too low to continue drilling. The drilling is then stopped by stopping rotation of the drilling head and a ball 32 is dropped into the casing string. The casing string is pressurised until the ball reaches a ball seat 20 arranged opposite or below (as shown in FIG. 11) the annular barrier closest to the drilling head. Subsequently, the expandable metal sleeves of the annular barriers are expanded by further pressurising the casing string 1A until the expandable metal sleeves abut the inner face of the borehole. The expandable metal sleeves of the annular barriers are thus expanded substantially simultaneously.

In order to insert a production casing in the top of the well, the second part may be disconnected from the first part and a production casing 55 is inserted for prolonging the casing string to the top of the well. Then, a packer 56 is set between the production casing and the intermediate casing 57.

Even though not shown, the first part of the casing string is mounted from casings sections, and the second part may be mounted from the drill pipe.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

Although the invention has been described in the above in connection with preferred embodiments of the invention, it will be evident for a person skilled in the art that several modifications are conceivable without departing from the invention as defined by the following claims.

The invention claimed is:

1. A downhole drilling method for drilling a well in a formation having a formation pressure, comprising:

providing a drill string having a first part and a second part, the second part being arranged closer to a top of the well than the first part, and the first part having a drilling head in a first end and an annular barrier arranged closer to the top of the well than the drilling head, the annular barrier comprising:

a tubular metal part for mounting as part of the first part of the drill string, the tubular metal part having an outer face, an expandable metal sleeve surrounding the tubular metal part and having an inner face facing the tubular metal part and an outer face facing an inner face of a borehole of the well, each end of the expandable metal sleeve being connected with the tubular metal part, and an annular space between the inner face of the expandable metal sleeve and the tubular metal part, the expandable metal sleeve being configured to expand, drilling the borehole by means of the drilling head, detecting the formation pressure to determine any loss of formation pressure, stopping the drilling, dropping a ball into the drill string, pressurising the drill string until the ball reaches a ball seat arranged above the drilling head and below the annular barrier, after a loss of formation pressure has been detected and a determination has been made to abandon a part of the well, expanding the expandable metal sleeve by further pressurising the drill string until the expandable metal sleeve abuts the inner face of the borehole, separating the second part of the drill string from the first part, pulling the second part out of the borehole, while leaving the drilling head and the annular barrier of the first part in the bottom of the well, and injecting cement into the borehole above the first part to provide a cement plug above the first part, on top of the expanded metal sleeve of the annular barrier and the first part of the drill string.

2. A downhole drilling method according to claim 1, wherein separating the first part and the second part is performed by disconnecting the second part from the first part by activating a disconnecting unit.

3. A downhole drilling method according to claim 2, wherein the activation of the disconnecting unit is performed by bursting a burst disc of the disconnecting unit by further pressurising the drill string until reaching a predetermined pressure which is larger than an expansion pressure required for expanding the expandable metal sleeve.

4. A downhole drilling method according to claim 1, wherein pulling of the second part is performed by pulling the second part partly away from the first part, then injecting cement through the second part into the borehole above the first part, and subsequently pulling the second part out of the borehole.

5. A downhole drilling system for performing the downhole drilling method according to claim 1 for drilling a borehole of a well in a formation having a formation pressure, comprising:

a drill string having a first part and a second part, the first part having a first end and a second end, the second end being connected to the second part, a drilling head connected to the first end, the first part comprising an annular barrier, the annular barrier comprising:

a tubular metal part for mounting as part of the first part of the drill string, the tubular metal part having an outer face, an expandable metal sleeve surrounding the tubular metal part and having an inner face facing the tubular metal part and an outer face facing an inner face of the borehole, each end of the expandable metal sleeve being connected with the tubular metal part, and an annular space between the inner face of the expandable metal sleeve and the tubular metal part, the expandable metal sleeve being configured to expand, wherein the first part comprises a ball seat arranged opposite or below the annular barrier, and wherein the downhole drilling system further comprises a disconnecting unit configured to disconnect the second part from the first part.

6. A downhole drilling method according to claim 1, wherein the injecting includes injecting cement into the first part of the drill string.

7. A downhole completion system for permanently completing a well having a borehole in a formation having a formation pressure, the downhole completion system comprising:

a casing string having a first part and a second part, the first part having a first end and a second end, the second end being connected to the second part, and a drilling head connected to the first end, wherein the first part of the casing string comprises at least two annular barriers, each annular barrier comprising:

a tubular metal part for mounting as part of the first part of the casing string, the tubular metal part having an outer face, an expandable metal sleeve surrounding the tubular metal part and having an inner face facing the tubular metal part and an outer face facing an inner face of the borehole, each end of the expandable metal sleeve being connected with the tubular metal part, and an annular space between the inner face of the expandable metal sleeve and the tubular metal part, the expandable metal sleeve being configured to expand, wherein the first part comprises a ball seat arranged above the drilling head and below the annular barrier closest to the drilling head, such that, in use, upon expansion of the expandable metal sleeve by dropping a ball into the ball seat and pressurizing the casing string, the drilling head is abandoned in the well.

8. A downhole completion system according to claim 7, wherein the second part is configured to be disconnected from the first part.

9. A downhole completion system according to claim 7, further comprising an inflow control section arranged between two annular barriers of the first part and/or the second part.

10. A downhole completion system according to claim 7, further comprising a detecting unit arranged at a top of the well.

11. A downhole completion system according to claim 7, wherein the tubular metal part has a first expansion opening, the expandable metal sleeve being configured to expand by injecting pressurised fluid into the annular space through the first expansion opening.

12. A downhole completion system according to claim 7, further comprising a pressurising device configured to pressurise the casing string.

13. A downhole drilling method for drilling a well in a formation having a formation pressure, comprising:

providing a casing string having a first part and a second part, the second part being arranged closer to a top of the well than the first part, and the first part having a drilling head in a first end and at least two annular barriers arranged closer to the top of the well than the drilling head, each annular barrier comprising:

a tubular metal part for mounting as part of the first part of the drill string, the tubular metal part having an outer face, an expandable metal sleeve surrounding the tubular metal part and having an inner face facing the tubular metal part and an outer face facing an inner face of a borehole of the well, each end of the expandable metal sleeve being connected with the tubular metal part, and an annular space between the inner face of the expandable metal sleeve and the tubular metal part, the expandable metal sleeve being configured to expand, drilling the borehole by means of the drilling head, detecting that the drilling has stopped or that the formation pressure is too low to continue drilling, stopping the drilling head, dropping a ball into the casing string, pressurising the casing string until the ball reaches a ball seat arranged above the drilling head and below the annular barrier closest to the drilling head, and after a loss of formation pressure has been detected and a determination has been made to abandon a part of the well, expanding the expandable metal sleeves of the annular barriers by further pressurising the casing string until the expandable metal sleeves abuts the inner face of the borehole so that the drilling head is abandoned in the well.

14. A downhole drilling method according to claim 13, wherein the expandable metal sleeves of the annular barriers are expanded substantially simultaneously.

15. A downhole drilling method according to claim 13, further comprising disconnecting the second part from the first part.

16. A downhole drilling method according to claim 13, further comprising inserting a production casing for prolonging the casing string to a top of the well.

* * * * *